US008646463B2

(12) United States Patent
Sherwood et al.

(10) Patent No.: US 8,646,463 B2
(45) Date of Patent: Feb. 11, 2014

(54) GRAVURE-PRINTED, BANDED CIGARETTE PAPER

(75) Inventors: Timothy S. Sherwood, Midlothian, VA (US); Firooz Rasouli, Midlothian, VA (US); Ping Li, Glen Allen, VA (US); Don E. Miser, Chesterfield, VA (US); Joe Yousef Mohajer, Midlothian, VA (US); Bruce E. Waymack, Prince George, VA (US); Tony A. Phan, Richmond, VA (US); Tracy L. Madison, Richmond, VA (US); John R. Tilley, Chesterfield, VA (US); Yezdi B. Pithawalla, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1619 days.

(21) Appl. No.: 11/500,918

(22) Filed: Aug. 9, 2006

(65) Prior Publication Data

US 2007/0102017 A1 May 10, 2007

Related U.S. Application Data

(60) Provisional application No. 60/707,964, filed on Aug. 15, 2005.

(51) Int. Cl.

| | |
|---|---|
| ***A24D 1/02*** | (2006.01) |
| ***D21H 11/00*** | (2006.01) |
| ***D21H 13/00*** | (2006.01) |
| ***D21H 15/00*** | (2006.01) |
| ***D21H 17/00*** | (2006.01) |
| ***D21H 19/00*** | (2006.01) |
| ***D21H 21/00*** | (2006.01) |
| ***D21H 23/00*** | (2006.01) |
| ***D21H 25/00*** | (2006.01) |
| ***D21H 27/00*** | (2006.01) |

(52) U.S. Cl.

USPC ..... 131/365; 131/360; 131/349; 131/347; 131/284; 162/139

(58) Field of Classification Search

None

See application file for complete search history.

(56) References Cited

U.S. PATENT DOCUMENTS

| | | | |
|---|---|---|---|
| 1,996,002 | A | 3/1935 | Seaman |
| 1,999,222 | A | 4/1935 | Weinberger |
| 2,718,889 | A | 9/1955 | Claussen |
| 3,030,963 | A | 4/1962 | Cohn |
| 4,044,778 | A | 8/1977 | Cohn |
| 4,077,414 | A | 3/1978 | Baker et al. |

(Continued)

OTHER PUBLICATIONS

International Search Report issued in PCT/IB2006/002653, dated May 1, 2007.

(Continued)

*Primary Examiner* — Richard Crispino
*Assistant Examiner* — Phu Nguyen
(74) *Attorney, Agent, or Firm* — Buchanan Ingersoll & Rooney PC

(57) ABSTRACT

A cigarette and cigarette paper have a plurality of multilayer bands formed by printing a highly viscous aqueous film-forming composition. After heating the composition to lower its viscosity, the bands are applied to the cigarette paper by gravure printing the composition. The composition is quenched and gelatinized by contact with the cool cigarette paper reducing absorption of water by the paper and reducing wrinkling, cockling, and waviness. Multiple gravure printed layers may be used to form the bands.

24 Claims, 2 Drawing Sheets

(56) References Cited

U.S. PATENT DOCUMENTS

| | | | | |
|---|---|---|---|---|
| 4,146,040 | A | 3/1979 | Cohn | |
| 4,187,862 | A | 2/1980 | Cohn | |
| 4,236,532 | A | 12/1980 | Schweizer et al. | |
| 4,277,301 | A | 7/1981 | McIntyre et al. | |
| 4,371,571 | A | 2/1983 | McIntyre et al. | |
| 4,438,694 | A | 3/1984 | Parkins et al. | |
| 4,452,259 | A | 6/1984 | Norman et al. | |
| 4,453,553 | A | 6/1984 | Cohn | |
| 4,567,372 | A | 1/1986 | Henry et al. | |
| 4,716,912 | A | 1/1988 | Leonard | |
| 4,739,775 | A | 4/1988 | Hampl, Jr. | |
| 4,784,163 | A | 11/1988 | Adams et al. | |
| 4,998,542 | A | 3/1991 | Kallianos et al. | |
| 5,144,967 | A | 9/1992 | Cartwright et al. | |
| 5,191,906 | A | 3/1993 | Myracle, Jr. | |
| 5,244,530 | A | 9/1993 | Collins et al. | |
| 5,263,999 | A | 11/1993 | Baldwin et al. | |
| 5,342,484 | A | 8/1994 | Cutright et al. | |
| 5,534,114 | A | 7/1996 | Cutright et al. | |
| 5,571,564 | A * | 11/1996 | Helms et al. | 427/288 |
| 5,589,034 | A | 12/1996 | Hultman et al. | |
| 5,690,787 | A | 11/1997 | Hultman et al. | |
| 5,820,998 | A | 10/1998 | Hotaling et al. | |
| 5,878,753 | A | 3/1999 | Peterson et al. | |
| 5,878,754 | A | 3/1999 | Peterson et al. | |
| 5,992,420 | A | 11/1999 | Moriyama | |
| 6,020,969 | A | 2/2000 | Struckhoff et al. | |
| 6,198,537 | B1 | 3/2001 | Bokelman et al. | |
| 6,676,806 | B1 | 1/2004 | Butt | |
| 6,705,325 | B1 | 3/2004 | Hicks et al. | |
| 6,706,120 | B2 | 3/2004 | Miyauchi et al. | |
| 6,725,867 | B2 | 4/2004 | Peterson et al. | |
| 6,776,168 | B1 | 8/2004 | Teufel et al. | |
| 6,779,530 | B2 | 8/2004 | Kraker | |
| 6,837,248 | B2 | 1/2005 | Zawadzki et al. | |
| 6,929,013 | B2 | 8/2005 | Ashcraft et al. | |
| 6,976,493 | B2 | 12/2005 | Chapman et al. | |
| 6,997,190 | B2 | 2/2006 | Stokes et al. | |
| 2002/0179106 | A1 | 12/2002 | Zawadzki et al. | |
| 2003/0136420 | A1 | 7/2003 | Kraker et al. | |
| 2004/0099280 | A1 | 5/2004 | Stokes et al. | |
| 2004/0118420 | A1 | 6/2004 | Barnes et al. | |
| 2004/0123874 | A1 | 7/2004 | Zawadzki et al. | |
| 2004/0129281 | A1 | 7/2004 | Hancock et al. | |
| 2004/0134631 | A1 | 7/2004 | Crooks et al. | |
| 2004/0182407 | A1 | 9/2004 | Peterson et al. | |
| 2004/0231685 | A1 | 11/2004 | Patel et al. | |
| 2004/0237978 | A1 | 12/2004 | Barnes et al. | |
| 2004/0255966 | A1 | 12/2004 | Kraker | |
| 2005/0000528 | A1 | 1/2005 | Bereman | |
| 2005/0005947 | A1 | 1/2005 | Hampl et al. | |
| 2005/0016556 | A1 | 1/2005 | Ashcraft et al. | |
| 2005/0022470 | A1 | 2/2005 | Focke et al. | |
| 2005/0022833 | A1 | 2/2005 | Gedevanishvili et al. | |
| 2005/0039764 | A1 | 2/2005 | Barnes et al. | |
| 2005/0039767 | A1 | 2/2005 | Mua et al. | |
| 2005/0051185 | A1 | 3/2005 | Rasouli et al. | |
| 2005/0056293 | A1 | 3/2005 | Zawadzki et al. | |
| 2005/0076925 | A1 | 4/2005 | Fagg et al. | |
| 2005/0076929 | A1 | 4/2005 | Fitzgerald et al. | |
| 2005/0087202 | A1 | 4/2005 | Norman et al. | |
| 2005/0103355 | A1 | 5/2005 | Holmes | |
| 2005/0115575 | A1 | 6/2005 | Seymour et al. | |
| 2005/0172977 | A1 | 8/2005 | Jadot et al. | |
| 2005/0194014 | A1 | 9/2005 | Read, Jr. | |
| 2005/0241659 | A1 | 11/2005 | Ashcraft et al. | |
| 2005/0241660 | A1 | 11/2005 | Ashcraft et al. | |
| 2006/0005847 | A1 | 1/2006 | Chapman et al. | |
| 2006/0011207 | A1 | 1/2006 | Chapman et al. | |
| 2006/0021625 | A1 | 2/2006 | Nyffeler | |
| 2006/0021626 | A1 | 2/2006 | Mua | |

OTHER PUBLICATIONS

International Preliminary Report on Patentability for PCT/IB2006/002653 dated Feb. 20, 2008.

* cited by examiner

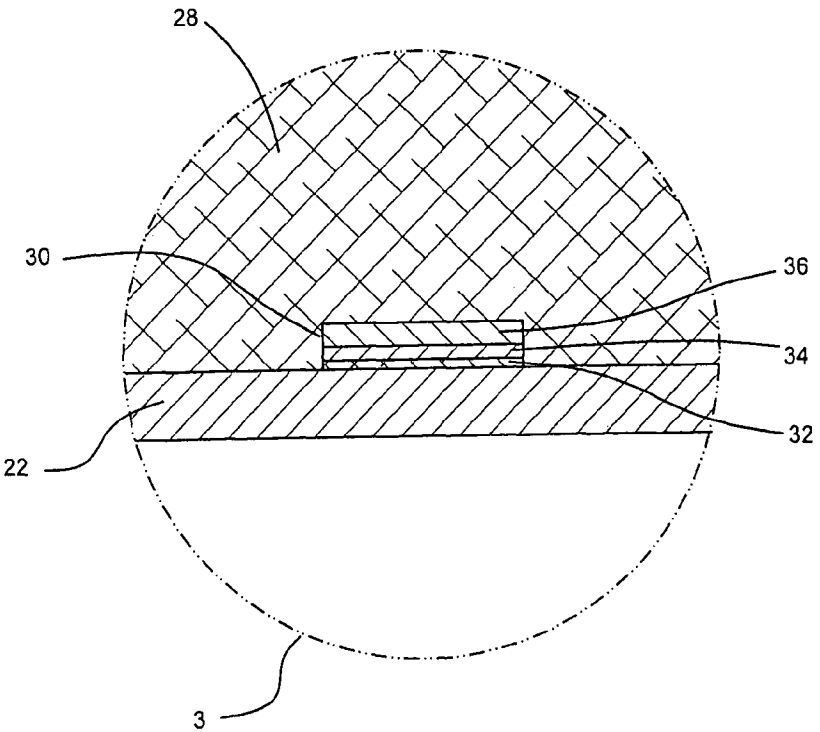
FIG. 3
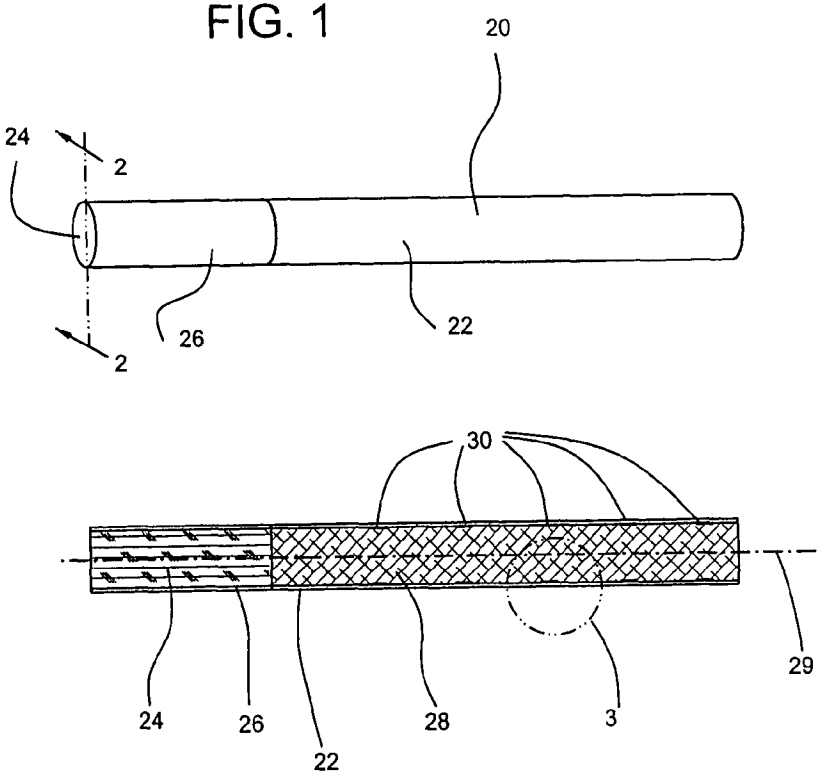
FIG. 1
FIG. 2

GRAVURE-PRINTED, BANDED CIGARETTE PAPER

CROSS REFERENCE TO RELATED APPLICATIONS

This application claims priority under 35 U.S.C. §119(e) to U.S. provisional Application No. 60/707,964, filed on Aug. 15, 2005, the entire content of which is incorporated herein by reference.

FIELD OF THE DISCLOSURE

This disclosure relates generally to banded paper for use in manufacturing cigarettes. More particularly, it concerns print banded paper made with a gravure printing process using an aqueous composition of highly viscous material.

SUMMARY

A cigarette according to one embodiment includes cigarette paper with a plurality of bands, each of which is effective to substantially reduce permeability of cigarette paper in its vicinity to control ignition propensity and inhibit unattended burning when the cigarette is left on a substrate. Each band may be formed by one or more layers, each of which may be applied by gravure printing. Moreover, the first layer (or layers) of each band is (or are) preferably formed using an aqueous film-forming composition having a viscosity not well-suited for gravure printing. The subsequent layer (or layers) of each band is (are) preferably formed by using the same aqueous film forming composition or other aqueous compositions containing fillers, burn inhibitors, burn promoters, flavors and the like.

During the gravure printing steps, the viscous film-forming composition is heated to a temperature where its viscosity lies within the range of viscosities suitable for gravure printing. When the heated film-forming composition is applied to the cigarette paper, the film-forming composition is cooled or quenched and may be gelatinized. Thus, a portion of the free water in the film-forming composition becomes bound and unavailable to soak or migrate into underlying fibers of the cigarette paper. That binding of free water inhibits formation of waviness, cockling, and/or wrinkling in the cigarette paper. Total coat weight for the band preferably lies in the range of 0.5 to 15 grams per square meter ("gsm"), and most preferably about 2 gsm. Permeability of the cigarette paper normally exceeds 20 Coresta units. However, permeability through the bands and the underlying cigarette paper preferably lies in the range of 0 to 15 Coresta units. The reduction in permeability preferably restricts air flow needed to support combustion of the cigarette coal in the vicinity of the band.

In a preferred embodiment, the film-forming composition used for printing comprises water and about 20% to about 50% film-forming compound selected from the group consisting of alginate, carrageenan, guar gum, pectin, calcium carbonate, and citrates. At higher concentrations of the film-forming compound in the composition, the composition may experience gelatinization when its temperature is rapidly reduced. Thus, the binding of free water into the printed band may occur.

According to a preferred method of manufacturing cigarette paper with bands, the cigarette paper advances to a first printing station. At that first printing station, the film-forming composition is heated so that its viscosity is decreased to a predetermined value useful for gravure printing. The heated film-forming composition is applied to the patterned surface of a rotating gravure cylinder. The rotating gravure cylinder may be heated to prevent premature cooling of the composition. The rotating gravure cylinder cooperates with a parallel impression roller to define a nip through which the cigarette paper advances. As the gravure cylinder rotates, its patterned surface contacts the cigarette paper and applies the first layer of the bands to the cigarette paper.

The film-forming composition is believed to cool and gel on contact with the cigarette paper. Thus, the water content of the film-forming composition is not appreciably absorbed into the cigarette paper and planarity of the cigarette paper is preserved.

After the first layer is applied to the cigarette paper it is allowed to dry thereon. The paper may then advance to a second gravure printing station where a second layer may be applied to the first layer of each band. Preferably, this optional second layer is coextensive with the first layer in both width and length; however, the second layer may be thicker than the first layer. The film-forming composition of the second layer gels on the cooler first layer—and free water does not get absorbed by the paper.

Optional third and successive layers may be applied on top of the second layer, and on underlying layers in the same way, preferably using the same film-forming composition, or different compositions containing fillers, burn inhibitors, burn promoters, flavors, and the like, as may be desired.

Another embodiment provides a process of applying only the first layer utilizing a heated gelatinizable film-forming solution, with one or more additional layers comprising a different add-on material such as a starch that is printable in an unheated state.

The resulting banded cigarette is collected on a reel that is subsequently cut into bobbins and used as cigarette paper to make cigarettes.

BRIEF DESCRIPTION OF THE DRAWINGS

The accompanying drawings depict a print banded paper where the bands are printed in multiple successive layers and apparatus for making such paper. In the accompanying drawings, like reference numerals are applied to like elements.

FIG. 1 is a perspective view of a cigarette made with paper having multilayer bands.

FIG. 2 is a cross-sectional view taken along the line 2-2 of FIG. 1.

FIG. 3 is an enlarged scale portion of FIG. 2 circumscribed by the line 3 with the thickness of the multilayer band exaggerated for purposes of clarity.

DETAILED DESCRIPTION

Figure 4:
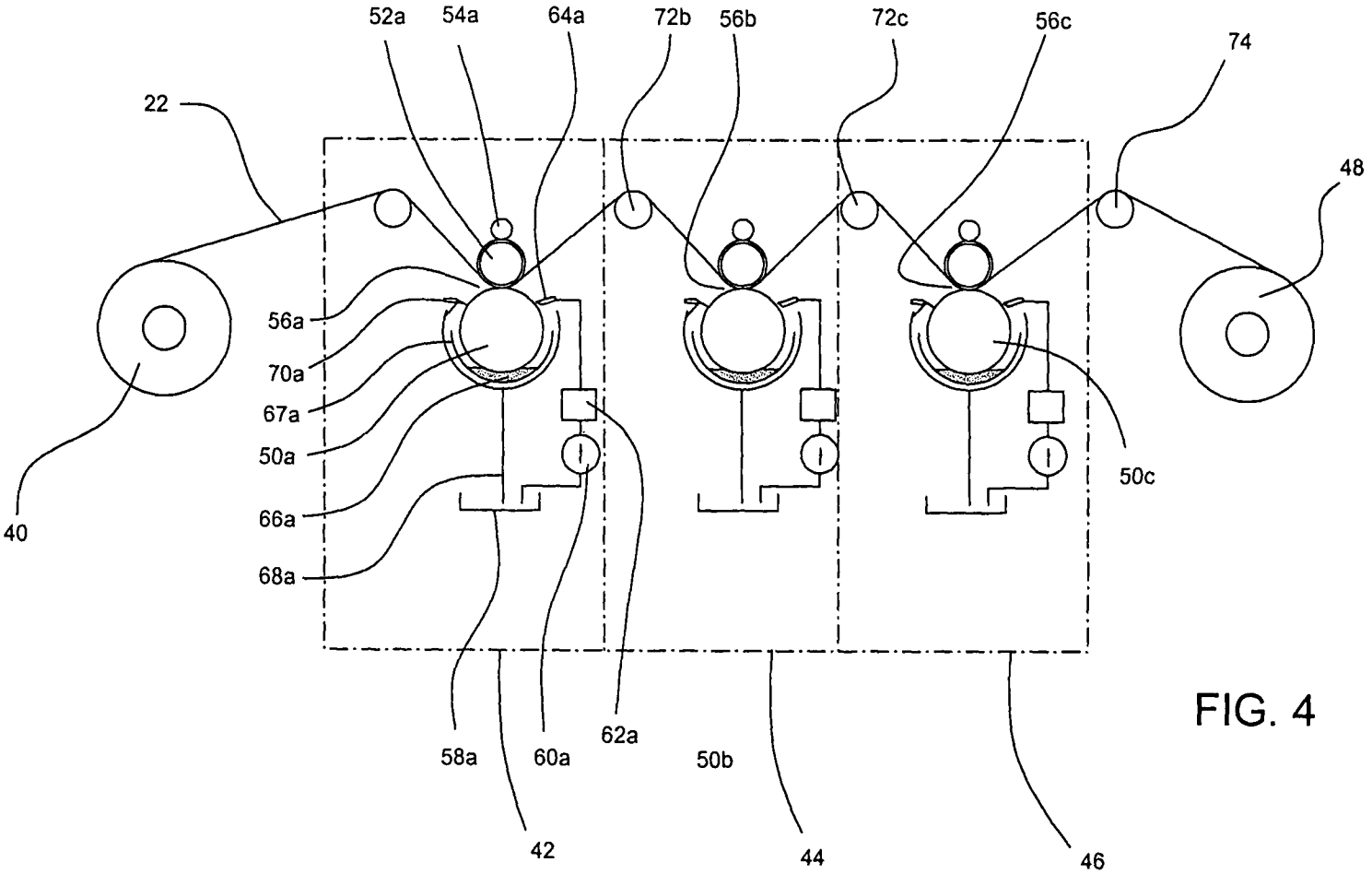
FIG. 4 is a schematic view of apparatus for preparing multi-layer print banded paper.

In accordance with this disclosure (see FIG. 1), a cigarette 20 includes a tobacco rod including cut filler, covered by cigarette paper 22. One end of the cigarette 20 may include a suitable filter 24 surrounded by suitable filter tipping paper 26.

The cigarette paper 22 (see FIG. 2) surrounds a column of tobacco 28 made from cut filler tobacco. The tobacco rod 28 has a nominal length measured along the longitudinal axis 29 which nominal length is the difference between the overall length and the length of the filter 24.

Conventional cigarette paper is permeable, with the permeability commonly designated in Coresta units. A Coresta unit measures paper permeability in terms of volumetric flow rate (i.e., $cm^3/sec$) per unit area (i.e., $cm^2$) per unit pressure drop (i.e., cm of water). Conventional cigarette papers also have well-known basis weights, measured in grams per square meter, abbreviated as "gsm". The permeability and basis weight for typical cigarette papers commonly used in the industry are set out in the table below:

| Permeability, Coresta units | Basis Weight, gsm |
|---|---|
| 24 | 25 |
| 33 | 25 |
| 46 | 25 |
| 60 | 26 |

For purposes of this disclosure, unbanded regions of a preferred cigarette paper have a permeability of at least 20 Coresta units. Most preferably, the cigarette paper has a permeability of about 33 to about 46 Coresta and a basis weight of about 25 gsm.

To regulate the ignition propensity of the cigarette and to inhibit unattended burning of the cigarette, the cigarette paper 22 has a plurality of bands 30 spaced axially along the tobacco rod 28. Permeability of the cigarette paper 22 through the area covered by the bands 30 preferably lies in the range of 0 to about 15 Coresta units. Typically, at least two bands 30 are disposed along the tobacco rod 28. Adjacent bands 30 are spaced from one another along the tobacco rod 28 by a nominal distance which preferably exceeds the width of the bands 30. However, that nominal distance is less than the nominal length of the tobacco rod 28. Each band 30 extends circumferentially around the tobacco rod 28 preferably on the inside of the cigarette paper 22. Accordingly, the presence of the bands 30 is essentially invisible from the outside of the cigarette.

Each band 30 (see FIG. 3) may comprise a plurality of layers. Two or three layers 32, 34, 36 may be provided. The first layer 32 rests directly on the inside (or alternatively, the outside) of the cigarette paper 22 and has a corresponding first-layer thickness. The optional second layer 34 lies on the first layer 32 and, preferably extends coextensively with the first layer both in width and length. The second layer 34 has a corresponding second-layer thickness. The optional third layer 36, lies on the second layer and, preferably extends coextensively with the second layer both in width and length. The third layer 36 has a third-layer thickness. Thicknesses of the various layers 32, 34, 36 are measured perpendicularly to the surface of the cigarette paper 22.

The first layer 32 is applied to the cigarette paper 22 to seal the paper surface from water penetration and thereby minimize resultant distortion of the cigarette paper 22 by way of wrinkling, cockling, and waviness. Such distortions can occur when paper fibers absorb water, then stretch and warp, and fail to return to their original position and state in the paper web. The first-layer thickness is selected such that aqueous solvent does not penetrate deeply into the paper 22. Thickness of the layers 32, 34, 36 is a direct function of coat weight. Accordingly, relative thicknesses of the layers correspond to relative coat weights, and vice versa.

In accordance a preferred embodiment, each band 30 is printed on the cigarette paper 22 by sequential gravure printing steps using an aqueous film-forming composition or other aqueous compositions as desired. The film-forming composition preferably includes water and a high concentration of a film-forming compound. For example, the film-forming compound preferably comprises about 20% to about 50%, by weight, of the film-forming composition. At room temperature (about 23° C.), the high-solid-content film-forming composition has a viscosity exceeding about 200 centipoise (cP) and is unsuitable for gravure printing; however, at a temperature in the range of about 40° to about 90° C., the viscosity of the film-forming composition is decreased sufficiently for use as a gravure printing composition. For gravure printing, the upper limit of suitable viscosity is about 200 cP. Most preferably, the film-forming composition has a viscosity of about 100 cP at a temperature in the range of 40° C. to 90° C. so that the composition can be quenched on contact with the paper after gravure printing at that temperature. The viscosity of the composition at room temperature is also important. The high viscosity at room temperature is needed so that the film-forming composition gels at room temperature.

The film-forming compound used in the film-forming composition may be selected from the group consisting of alginate, carrageenan, guar gum, pectin, calcium carbonate, and citrates. Preferably, the film-forming compound is selected from the group consisting of an oxidized starch, such as tapioca.

Preferably, the bands 30 are applied to the cigarette paper 22 using a sequential gravure printing process (see FIG. 4). Gravure printing operations are capable of precise registry of successive printing operations. Accordingly, gravure printing can be used to effectively print not only the first layer 32 of the bands 30, but also the second layer 34 substantially coextensive with the first layer, and the third layer 36 substantially coextensive with the second layer.

With the first layer 32 sealing the surface of the cigarette paper 22, the optional second layer can be applied with a heavier coat weight, i.e., coat thickness. If desired, the second layer 34 may be thicker than the first layer 32 by a factor of at least about 1.5 times the first-layer thickness, or at least a 50% increase in coat weight. Moreover, the optional third layer 36 may be thicker than the second layer 34 and may also be thicker than the first layer 32 by a factor of at least about 2.5 times the first-layer thickness—i.e., an increase of at least about 150% in coat weight.

The gravure printing process can be used immediately following paper manufacture, i.e., at the end of the paper making machine. Alternatively, the gravure printing process can be used in connection with reels carrying the cigarette paper onto which the bands are to be printed. For example, a reel 40 of cigarette paper having a selected permeability and a selected basis weight is mounted so that the cigarette paper 22 can be unspooled from the reel 40 as a continuous paper web.

The web of cigarette paper 22 advances or passes through a first gravure printing station 42 where the base layer 32 of each band 30 is printed on the paper 22. The printing process may be applied to the felt side or the wire side of the paper, or both. Next, the cigarette paper 22 passes through a second gravure printing station 44 where the second layer 34 of each band 30 is printed on the corresponding base layer 32. The cigarette paper 22 then passes through a third gravure printing station 46 where the third layer 36 of each band 30 is printed on the corresponding second layer 34. Additional layers are applied in a similar manner as described. Finally, the cigarette paper 22 with the printed bands is wound up on a collection reel 48. The collection reel 48 is then slit into bobbins. The bobbins are used for wrapping tobacco rods during manufacture of cigarettes in an otherwise conventional way.

The apparatus at each of the three gravure printing stations 42, 44, 46 is essentially the same in its material aspects. Accordingly, it will suffice to describe one of the gravure printing stations in detail, it being understood that the other gravure printing stations have common features, unless otherwise noted. Thus, features of the first gravure printing station 42 will use reference numerals with the suffix "a". Corresponding features of the second gravure printing station 44 will use the same reference numeral but will use the suffix "b". Likewise, corresponding features of the third gravure printing station 46 will use the same reference numeral but will use the suffix "c".

At the first gravure printing station 42, the apparatus includes a gravure cylinder or roller 50*a* generally mounted for rotation around a horizontal axis. The generally cylindrical surface of the roller 50*a* is patterned in a suitable process to define a negative of the first layer 32 of bands 30. Conventional engraving, chemical engraving, electronic engraving, and photo etching can be used to pattern the surface of the gravure cylinder. The circumference of the roller 50*a* is determined such that it is an integral multiple of the sum of the nominal distance between bands plus the band width. Thus, for each revolution of the roller 50*a*, that integral number of first layers of the bands is printed on the cigarette paper.

An impression cylinder 52*a* is mounted for counter-rotation on an axis parallel to the axis of the roller 50*a*. In some applications, the impression cylinder 52*a* includes a nonmetallic resilient surface. The impression cylinder 52*a* is positioned between the roller 50*a* and a backing roller 54*a*, which is also mounted for rotation on an axis parallel to the axis of the roller 50*a* and which counter-rotates relative to the impression cylinder 52*a*. One of the functions provided by the backing roller 54*a* is stiffening the central portions of the impression cylinder 52*a* so that the uniform printing pressure is attained between the roller 50*a* and the impression cylinder 52*a*. The gravure cylinder or roller 50*a* and the impression cylinder 52*a* cooperate to define a nip 56*a* through which the paper web 22 advances during the printing process. That nip 56*a* is sized to pinch the paper web 22 as it moves between the gravure cylinder 50*a* and the impression cylinder 52*a*. The nip pressure on the paper web is critical to ensure the correct transfer of the composition from the cylinder to the paper.

A reservoir 58*a* contains the film-forming composition discussed above for forming bands on the cigarette paper. The reservoir 58*a* communicates with a suitable pump 60*a* which is capable of handling the viscous film-forming composition. The film-forming composition may then flow to a suitable heat exchanger 62*a* where the temperature of the film-forming composition is elevated so that it lies in the range of about 40° to about 90° C. so that the viscosity of the film-forming composition is adjusted to a level which is suitable for gravure printing. As discussed above, viscosity for gravure printing needs to be less than about 200 cP. Preferably, the temperature of the film-forming composition is selected so that the viscosity is less than about 100 cP.

While a separate heat exchanger 62*a* is disclosed, it may be desirable to provide thermal conditioning of the film-forming composition in the reservoir 58*a* itself. For example, heating elements and stirring apparatus may be included in the reservoir 58*a* to maintain the elevated temperature for the film-forming composition. Placement of the thermal conditioning in the reservoir 58*a* has the advantage of making pump selection and operating requirements simpler since the pump 60*a* need not handle the film-forming composition at the higher viscosity associated with lower temperatures because the film-forming composition would already be heated and, therefore, at the lower viscosity. Whether thermal conditioning occurs in the reservoir 58*a* or in a separate heat exchanger 62*a*, it is important that the thermal conditioning step occur at a temperature selected to avoid scorching the film-forming composition. Scorching can cause discoloration of the film-forming composition, and can affect the film-forming characteristics of the composition. Thus, scorching is to be avoided while the film-forming composition is subjected to thermal conditioning.

Regardless of where the thermal conditioning step occurs, the heated film-forming composition is delivered to a suitable applicator 64*a* that spreads the film-forming composition along the length of the gravure cylinder 50*a*. That spreading step may be effected by pouring or spraying the film-forming composition onto the gravure cylinder 50*a*, or simply by delivering the liquid film-forming composition to a bath 66*a* of film-forming composition that collects at the bottom of the gravure cylinder 50*a*, between the gravure cylinder 50*a* and a collector 67*a*. The cylinder may be heated to prevent premature cooling of the composition.

Generally, the collector 67*a* extends vertically around the gravure roller 50*a* to a height sufficient to collect the bath 66*a*, but to a height well below the top of the gravure cylinder 50*a*. When the bath 66*a* reaches the top of the collector 67*a*, film-forming composition can flow through a drain 68*a* at the bottom of the apparatus back into the reservoir 58*a*. Thus, the film-forming composition circulates through the printing station and can be maintained at suitable printing viscosity by the thermal conditioning apparatus discussed above.

As the gravure cylinder 50*a* rotates through the applicator 64*a* and/or the bath 66*a*, the film-forming composition adheres to the surface of the gravure cylinder 50*a*, including in the impressions provided therein to define the bands. Further rotation of the gravure cylinder 50*a* toward the nip 56*a* moves the cylinder surface past a suitable doctor blade 70*a*. The doctor blade 70*a* extends along the length of the gravure cylinder and is positioned so that is wipes the surface of the gravure cylinder 50*a*. In this way, those portions of the gravure cylinder 50*a* that define the nominal spacing between adjacent bands is essentially wiped clean of the film-forming composition, while engraved portions of the gravure cylinder that define the bands themselves advance toward the nip 56*a* full of the film-forming composition.

As the cigarette paper 22 and the surface of the gravure cylinder 50*a* move through the nip 56*a*, the film-forming composition is transferred to the surface of the cigarette paper 22. The linear speed or velocity of the cigarette paper 22 matches the tangential surface speed of both the gravure cylinder 50*a* and the impression cylinder 52*a* as the cigarette paper 22 passes through the nip 56*a*. In that way, slippage and/or smearing of the film-forming composition on the cigarette paper 22 are avoided.

When the bands are printed on the cigarette paper 22 at the first printing stations 42, the heated film-forming composition encounters cigarette paper 22 at room temperature of about 23° C.—which is considerably cooler than the temperature of the film-forming composition—i.e., about 40° to about 90° C. Upon contact with the paper 22, the temperature of the film-forming composition is quenched to the temperature of the paper 22. That quenching occurs through several heat transfer processes or mechanisms. The paper 22 has a sufficiently large thermal mass when compared to the thickness and width of the first layer of the band, that the film-forming material in the band equilibrates to a temperature near to the temperature of the paper rapidly, if not immediately. The temperature of air near the paper 22 and the gravure cylinder 50*a* is also well below the temperature of the film-forming material on the surface of the gravure cylinder 50*a* so cooling to ambient air also occurs. In addition, movement of the surface of the gravure cylinder 50*a*, as well as movement of the cigarette paper 22 after printing, contributes to convective cooling of the film-forming material.

The combined cooling effect of those heat transfer mechanisms causes the film-forming material to gel on the surface of the cigarette paper 22. That gelling of the first layer of the band tends to bind water in the film-forming composition so that the water does not penetrate deeply into, and possibly saturate, the cigarette paper 22. As a result, fibers of the cigarette paper 22 typically are not wetted by water to such an extent that the fibers warp and stretch in a way that leads to waviness, wrinkling, and/or cockling in the cigarette paper 22. The impression cylinder 52*a* can optionally be cooled to further accelerate gelatinization of the film-forming composition on the cigarette paper. Additional techniques may be used to reduce water absorption. For example, acceleration of solidification of the film forming material may be effected by mixing alginate with a calcium sale, such as calcium chloride, in situ or by exposure to ultraviolet light.

As the cigarette paper 22 leaves the first printing station 42, moisture in the film-forming composition is permitted to dry. To this end, suitable arrangements (not shown) may be employed.

Cigarette paper with the first layer of the bands printed at the first gravure printing station 42 then pass over an adjustment cylinder 72*b* of the second gravure printing station 44. The gravure cylinder 50*b* of the second printing station has a patterned surface that is designed to print the second layer of the bands. The depth of the pattern on the surface of the gravure cylinder 50*b* is selected to be about 1.5 times the depth of the pattern on the first gravure cylinder 50*a*. Preferably, the second layer of the bands will be coextensive in width (in the direction of paper movement) and coextensive in length (in the direction transverse to paper movement) with the first layer of the band. The gravure cylinder 50*b* of the second printing station 44 must therefore be registered with the gravure cylinder 50*a* of the first printing station 42. While various techniques for assuring that registration are known to those skilled in the art, the adjustment cylinder 72*b* can be used to assure correct registration. More particularly, the length of the cigarette paper 22 between the nip 56*a* of the first printing station 42 and the nip 56*b* of the second printing station 44 depends on the vertical position of the adjustment cylinder 72*b*. By adjusting the position of the cylinder 72*b*, proper registration between the first and second print stations 42, 44 can be achieved and, if necessary, adjusted.

As the cigarette paper 22 moves from the second printing station 44 to the third printing station 46, the film-forming composition applied at the second printing station 44 has sufficient time to dry. After passing over the adjustment roller 72*c* of the third printing station 46, the cigarette paper 22 enters the nip 56*c* of the third printing station 46 where the third layer of the bands is applied.

The gravure cylinder 50*c* of the third printing station 46 has a patterned surface that is designed to print the third layer of the bands. The depth of the pattern on the surface of the gravure cylinder 50*c* is selected to be about 2.5 times the depth of the pattern on the first gravure cylinder 50*a*. Preferably, the second layer of the bands will be coextensive in width (in the direction of paper movement) and coextensive in length (in the direction transverse to paper movement) with both the first layer and the second layer of the band. The gravure cylinder 50*c* of the third printing station 44 must therefore be registered with the gravure cylinder 50*b* of the second printing station 44. As described above, the adjustment cylinder 72*c* can provide that registration function.

After leaving the third printing station 46, the third layer of the band is allowed to dry before encountering the idler roller 74. Additional printing stations (not shown) may be used, as desired. The cigarette paper 22 with the multi-layer bands is then collected on the collection reel 48.

The bands 30 are applied with a low coat weight. For example, the total coat weight may lie in the range of about 0.5 to about 15 gsm for the multiple layers of the bands 30. Preferably, the coat weight may be about 2 gsm. With those coat weights, the thickness of the multilayer bands 30 (FIG. 3) preferably is less than about 20% of the thickness of the cigarette paper, and may be less than 5% of the thickness of the cigarette paper. The thickness of the first layer 32 of the band 30 applied in the first gravure printing station, preferably is less than 4% of the cigarette paper thickness, and may be less than 1% of the cigarette paper thickness. Thus, it is seen that the thickness of the first layer is small in relation to the thickness of the underlying cigarette paper.

By heating the film-forming composition, gelatinization of the film-forming compound upon cooling is enhanced. Accordingly, when the film-forming composition is quenched at the surface of the cigarette paper 22, a gel forms. Formation of the gel binds some of the water from the composition and prevents that water from entering fibers of the cigarette paper. This effect further reduces the possibility that printing of the aqueous film-forming composition will lead to waviness or other imperfections in the resulting banded cigarette paper.

While the process for making banded cigarette paper according to this disclosure will be apparent to those skilled in the art from the foregoing description, the process will nevertheless be summarized below.

Cigarette paper mounted on a reel 40 (see FIG. 4), advances as a paper web 22 to a first printing station 42. At that first printing station 42, gravure printing apparatus prints a first layer of the film-forming composition on the cigarette paper 22. That printing step includes heating the film-forming composition to temperature where viscosity of the film-forming composition drops below the threshold for gravure printing while avoiding temperatures that could scorch the film-forming material. The heating step reduces viscosity of the film-forming material below about 200 cP, and most preferably to around 100 cP or less.

The heated film-forming composition is applied to the patterned surface of a rotating gravure cylinder 50*a*. Application of the composition to the patterned surface may be accomplished by pouring or spraying the composition on the patterned surface or by moving the patterned surface through a bath of heated composition. Regardless of the application technique used, excess composition is wiped from the patterned surface of the gravure cylinder 50*a* with a doctor blade.

Thereafter, the rotating surface of the gravure roller 50*a* contacts the advancing cigarette paper as it moves through the nip 56*a*. There, the film-forming composition transfers from the patterned surface of the gravure cylinder 50*a* to the cigarette paper 22 and is quenched by contact with the cigarette paper surface. Gelatinization of the film-forming composition on the surface of the cigarette paper 22 binds at least a portion of the free water in the film-forming composition so that the water content of the composition does not disrupt planarity of the cigarette paper and cause cockling, waviness, and/or wrinkling.

The first layer 32 of the bands 30 then dries as the cigarette paper 22 continues to advance through the printing operations. When the first layer 32 has dried, it enters a second gravure printing station 44 where a second layer of the bands 34 is applied. The gravure printing at the second station 44 and the film-forming composition used are processed in the same way as described above in connection with the first printing station 42. However, the patterned surface of the second gravure cylinder 50*b* is prepared so that the thickness of bands it applies exceeds the thickness of the first layer. The second layer of each band is printed on the first layer so as to be coextensive with the first layer, both in width and in length.

After the second layer of the bands dries, the cigarette paper advances to the third gravure printing station 46 where a third layer may be printed on the second layer in the manner just described. At the third station 46, the patterned surface of the gravure cylinder is prepared so that the thickness of bands it applies exceeds the thickness of the second layer.

When all the desired layers have been printed on the cigarette paper 22, the paper is wound on a collection reel 48 for subsequent use in manufacture of cigarettes.

The terms and phases used herein are not to be interpreted with mathematical or geometric precision, rather geometric terminology is to be interpreted as meaning approximating or similar to the geometric terms and concepts. Where the term "about" is used in relation to a number, it is intended that such number has a tolerance of plus or minus 5%. Similarly, such terms as "generally" and "substantially" are intended to encompass both precise meanings of the associated terms and concepts as well as to provide reasonable latitude which is consistent with form, function, and/or meaning.

It will now be apparent to those skilled in the art that this specification describes a new, useful, and nonobvious progressive multi-pass print banded paper. It will also be apparent to those skilled in the art that numerous modifications, variations, substitutes, and equivalents exist for various aspects of the invention that have been described in the detailed description above. Accordingly, it is expressly intended that all such modifications, variations, substitutions, and equivalents that fall within the spirit and scope of the invention, as defined by the appended claims, be embraced thereby.

What is claimed is:

1. A method of making banded cigarette paper comprising the steps of:

advancing cigarette paper to a first printing station;

printing a first layer of a film-forming composition directly on the cigarette paper, the composition comprising a viscous aqueous solution of 20 to 50% by weight of a film-forming compound, including:

heating the film-forming composition;

applying the heated film-forming composition to a patterned gravure cylinder;

contacting the advancing cigarette paper with the patterned gravure cylinder; and gelling the film-forming composition by contact with the cigarette paper surface and by quenching the film-forming composition so that the film-forming composition does not disrupt planarity of the cigarette paper wherein the quenching step includes using a nip roller while cooling the nip roller.

2. The method of making banded cigarette paper of claim 1, wherein the film-forming composition is heated to a temperature in the range of 40° to 90° C.

3. The method of making banded cigarette paper of claim 2, wherein the upper limit of the temperature of the heating step is selected to avoid scorching the film-forming composition.

4. The method of making banded cigarette paper of claim 1, wherein the quenching step also includes cooling the cigarette paper.

5. The method of making banded cigarette paper of claim 1, including the step of printing a second layer of the film-forming composition on top of the first layer.

6. The method of making banded cigarette paper of claim 5, wherein the plurality of layers have a combined coat weight in the range of 0.5 to 15 gsm.

7. The method of making banded cigarette paper of claim 6, wherein the plurality of layers have a combined coat weight of about 5 gsm.

8. The method of making banded cigarette paper of claim 5, wherein the second layer is printed with a coat weight about 50% greater than the coat weight of the first layer.

9. The method of making banded cigarette paper of claim 5, wherein a third layer is printed with a coat weight about 150% greater than the coat weight of the first layer.

10. The method of making banded cigarette paper of claim 1 wherein permeability of the cigarette paper through the film-forming layer lies in the range of 0 to about 15 Coresta units.

11. The method of making banded cigarette paper of claim 1, wherein the film-forming compound is selected from the group consisting of starch, alginate, carrageenan, guar gum, pectin, calcium carbonate, and citrates.

12. The method of making banded cigarette paper of claim 1, further including the step of patterning the gravure cylinder by one of engraving, chemical engraving, electronic engraving and photo etching.

13. The method of making banded cigarette paper of claim 1, further including the step of heating a gravure cylinder to limit premature cooling of the film-forming composition.

14. The method of making banded cigarette paper of claim 1, wherein at least one printing step includes using a cooled impression cylinder to accelerate gelatinization.

15. The method of claim 1, wherein the film-forming composition is heated to a temperature in the range of 40° C. to 90° C. and then cooling the film-forming composition to room temperature.

16. The method of claim 1, wherein the film-forming composition comprises water and starch.

17. The method of claim 1, wherein the film-forming composition comprises water and carrageenan.

18. The method of claim 1, wherein the film-forming composition comprises water and guar gum.

19. The method of claim 1, wherein the film-forming composition comprises water and pectin.

20. The method of claim 1, wherein the film-forming composition comprises water and an oxidized starch.

21. The method of claim 1, wherein the film-forming composition comprises water and tapioca.

22. The method of making banded cigarette paper of claim 1, including the further step of printing at least a second layer of the film-forming composition on the first layer.

23. The method of making banded cigarette paper of claim 1, wherein the aqueous film-forming composition comprises starch and calcium carbonate.

24. The method of claim 1, wherein the film-forming composition comprises water, starch and calcium carbonate.

* * * * *